US007757345B2

(12) United States Patent
Roschi et al.

(10) Patent No.: US 7,757,345 B2
(45) Date of Patent: Jul. 20, 2010

(54) SUCTION NOZZLE FOR VACUUM CLEANER OR THE LIKE WITH DETACHABLE SUCTION DUCT

(75) Inventors: Riccardo Roschi, Varese (IT); Ermes Roschi, Varese (IT)

(73) Assignee: New Ermes Europe S.p.A., Albiazzate (Varese) (IT)

( * ) Notice: Subject to any disclaimer, the term of this patent is extended or adjusted under 35 U.S.C. 154(b) by 1323 days.

(21) Appl. No.: 11/139,997

(22) Filed: May 31, 2005

(65) Prior Publication Data

US 2005/0262662 A1 Dec. 1, 2005

(30) Foreign Application Priority Data

May 28, 2004 (IT) ..... MI2004A1074

(51) Int. Cl.
*A47L 9/02* (2006.01)

(52) U.S. Cl. ..... 15/415.1; 15/414

(58) Field of Classification Search ..... 15/415.1, 15/414–417, 410, 405, 322
See application file for complete search history.

(56) References Cited

U.S. PATENT DOCUMENTS

| | | | | |
|---|---|---|---|---|
| 4,319,379 | A | 3/1982 | Carrigan et al. | |
| 4,336,628 | A * | 6/1982 | Bradshaw et al. | 15/415.1 |
| 6,519,810 | B2 * | 2/2003 | Kim | 15/415.1 |
| 7,222,393 | B2 * | 5/2007 | Kaffenberger et al. | 15/373 |
| 2001/0037536 | A1 * | 11/2001 | Kim | 15/361 |
| 2006/0000053 | A1 * | 1/2006 | Lim et al. | 15/415.1 |

FOREIGN PATENT DOCUMENTS

| | | | |
|---|---|---|---|
| DE | 16 28 579 | A | 2/1971 |
| DE | 40 28 113 | A | 3/1992 |
| DE | 296 08 726 | U | 7/1996 |
| DE | 196 17 415 | A | 11/1997 |
| EP | 0 737 437 | A | 10/1996 |
| FR | 2 483 766 | A | 12/1981 |
| GB | 2 072 495 | A | 10/1981 |

OTHER PUBLICATIONS

EP Search Report completed May 2, 2005 in corresponding IT application No. IT MI20041074.

* cited by examiner

*Primary Examiner*—Dung Van Nguyen
(74) *Attorney, Agent, or Firm*—Nixon & Vanderhye, P.C.

(57) ABSTRACT

A suction nozzle (otherwise called "brush") for sucking up dust and/or fluids and/or waste from a surface is described. The suction nozzle comprises a base plate with at least one channel open towards said surface, a suction duct in fluid communication with the at least one channel of the base plate and a body associated with said base plate. According to the invention, the suction duct is produced as a component separate from the plate and the body. Connection means are also provided for connecting the suction duct to the body and/or to the base plate. Owing to the present invention, more efficient suction ducts which produce less noise than the known ducts may be produced.

9 Claims, 7 Drawing Sheets

SUCTION NOZZLE FOR VACUUM CLEANER OR THE LIKE WITH DETACHABLE SUCTION DUCT

This application is a new U.S. patent application that claims benefit of IT MI2004A 001074, filed 28 May 2004, the entire contents of each of which are hereby incorporated by reference.

BACKGROUND

I. Field of the Invention

The present invention relates to a suction nozzle to be mounted on an electric household appliance for cleaning by means of suction, such as for example a vacuum cleaner, an electric brush or a multi-purpose hoover, for sucking dust and/or fluids and/or waste from a surface. In particular, the present invention relates to a suction nozzle with a suction duct which can be detached both from a base plate and from a covering body.

II. Related Art and Other Considerations

As is known, a vacuum cleaner, an electric brush or a similar electric household appliance for cleaning by means of suction comprises a suction nozzle for sucking up dust, waste or fluids from a surface. In the field of electric household appliances, a suction nozzle is generally defined by the term "brush". For the purposes of the present description, therefore, the terms "suction nozzle" and "brush" are considered to be equivalent. Still for the purposes of the present invention, the term "vacuum cleaner" will be used with a wider meaning so as to include all the apparatus, for professional or domestic use, which perform cleaning by means of suction. Therefore, the term "vacuum cleaner" will comprise a vacuum cleaner, an electric brush, a so-called multi-purpose hoover and a steam supply and suction apparatus.

Basically, a first known type of brush comprises a base plate which is shaped so as to have at least one base plate channel open towards the surface to be cleaned, a suction duct integral with the base plate and in fluid communication with the base plate channel and a covering body which can be joined to the base plate/suction duct assembly. The other end of the suction duct communicates with a suction tube by means of a rotatable articulated joint.

A second known type of brush comprises a base plate shaped so as to have at least one base plate channel open towards a surface to be cleaned, a covering body which can be joined to the base plate and a suction duct integral with the covering body and in fluid communication with the base plate channel. The other end of the suction duct communicates with a suction tube by means of a rotatable articulated joint.

In an embodiment of a brush of the second known type manufactured by the Applicant and marketed under the name "NE00", a cover-piece shaped so as to cover the part of the body/channel assembly in the zone above the said duct is provided. The cover-piece is provided mainly for aesthetic reasons.

In other words, at present, the suction duct is integral, i.e. forms one piece, either with the base plate or with the covering body. Usually, the base plate, the suction duct and the body of a suction nozzle (in addition to other components) are made of a plastic material which is substantially rigid and are obtained by means of injection-moulding. Precisely for this reason it is currently considered convenient by manufacturers to mould the suction duct integrally with the base plate or the body in such a way as to limit the number of moulds and number of parts to be assembled. A brush with base plate made of metallic material is also known, but in this case the suction duct is integral with an additional plate which can be fixed to the metal plate.

For the purposes of the present patent application, the term "suction duct" will be understood as meaning a component which is substantially rigid (and not, for example, made of rubber or soft plastic material of the bellows type) and with a length greater than or equal to 2.5 cm.

The abovementioned objective of limiting the number of moulds and components to be assembled so as to form a suction nozzle is stated, for example, in the patent DE 196 17 415 C2.

On the basis of the state of the art described above, the Applicant has considered a first problem of improving the suction characteristics of a suction nozzle.

The Applicant has noted that, in a suction nozzle, two main factors help improve these characteristics: the shape of the channel (or channels) in the base plate and the shape of the suction duct, in particular its inlet mouth. While it is relatively simple to modify (modifying the mould in a corresponding manner) the shape of the base plate when the base plate is separate from the suction duct, it is extremely difficult to modify the shape of the suction duct. This is because, as mentioned above, the suction duct (substantially a shaped, curved, tubular element) is integral with the body or the base plate (which are instead shell-shaped and substantially open elements) and the mould cannot be freely modified. In other words, the design engineer is obliged to make a compromise from the point of view of the performance characteristics in order to ensure that the assembly consisting of suction duct and base plate or suction duct and body can be produced at an acceptable cost.

A further problem addressed by the Applicant is that of limiting the noise in a suction nozzle due to the passage of air. In this case also, the Applicant has discovered that, in order to limit the suction noise, it is necessary to use a suitable shape (cross-section, length and curvature) of the suction duct. Once again, however, the modifications which can actually be made are limited by the fact that the suction duct is formed as one piece with the body or with the base plate.

A further problem considered by the Applicant is that of making easier, more practical and less costly the production of a suction nozzle so that it may assume different characteristics depending on the intended use. At present, in order to manufacture a new suction nozzle with a new shape and/or which is more suitable for sucking up certain materials and/or which is more advantageously able to be associated with a given motor of the vacuum cleaner, it is necessary to provide new moulds for the suction duct/body assembly or for the suction duct/plate assembly. This is not practical, nor is it economical, and this therefore represents an obstacle to the development of new products able to satisfy specific requirements.

BRIEF SUMMARY

A suction nozzle comprises a suction duct which is not integral with a body or base plate, but is a separate (or rather detachable) component, even though it may be fixed firmly to the base plate or to the body.

Advantageously, the suction duct may be joined to the base plate by means of an interlocking system or any other locking system.

Therefore, a suction nozzle (otherwise called "brush") for a vacuum cleaner for sucking up dust and/or fluids and/or waste from a surface, comprises a base plate with at least one channel open towards said surface, a suction duct in fluid communication with the at least one channel of the base plate and a body associated with said base plate, said suction duct being produced as a component separate from said plate and from said body and connection means being provided for connecting said suction duct to at least either one of said body and said base plate.

According to a preferred embodiment, said connection means comprise a mechanical snap-engaging system According to a further embodiment, said connection means comprise a screw-type or similar fixing system.

According to yet another embodiment, said connection means comprise a substantially inseparable fixing system, typically realized by means of adhesive, hot-plate bonding or ultrasound.

According to yet another embodiment, said connection means comprise a combination of one or more of the following systems: mechanical snap-engaging system, screw-type or similar fixing system, substantially inseparable fixing system (by means of adhesive, hot-plate bonding or ultrasound).

Conveniently, said suction duct is fixed to said base plate substantially at its end which is in fluid communication with the at least one base plate channel.

Preferably, said suction duct and said base plate comprise positioning/engaging members for correctly joining together suction duct and base plate.

According to a preferred embodiment, said positioning/engaging members comprise at least one pin projecting from said base plate and said suction duct comprises at least one corresponding cavity complementing said at least one pin.

BRIEF DESCRIPTION OF THE DRAWINGS

There now follows a detailed description of the invention, provided purely by way of a non-limiting example, to be read with reference to the accompanying plates of drawings in which.

DETAILED DESCRIPTION

Figure 1:
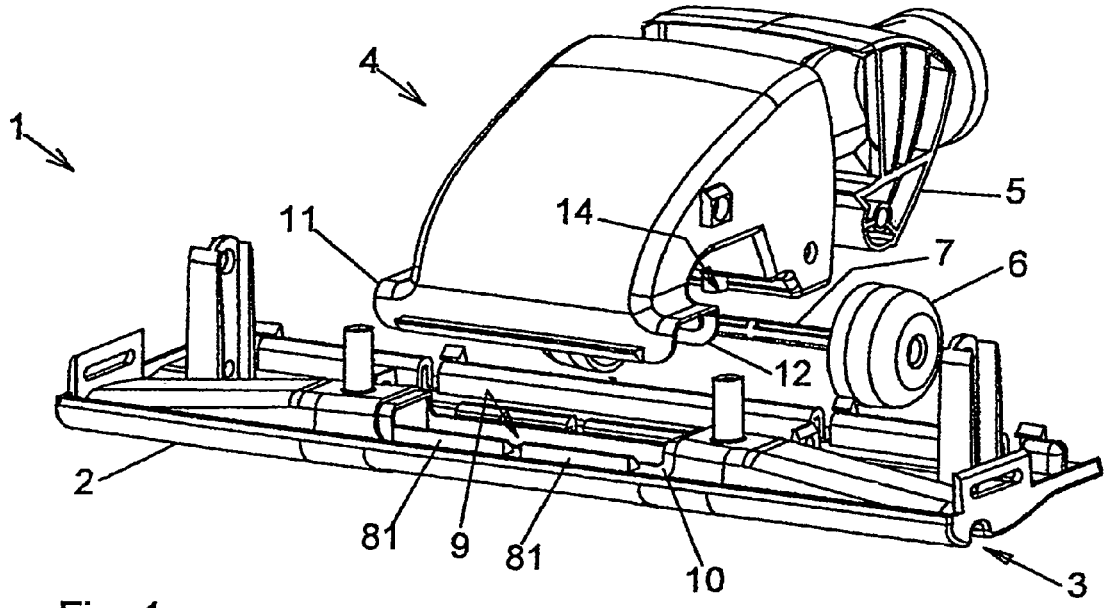
FIG. 1 shows an exploded axonometric view of a suction nozzle with separate/detachable suction duct according to an example embodiment.
Figure 2:
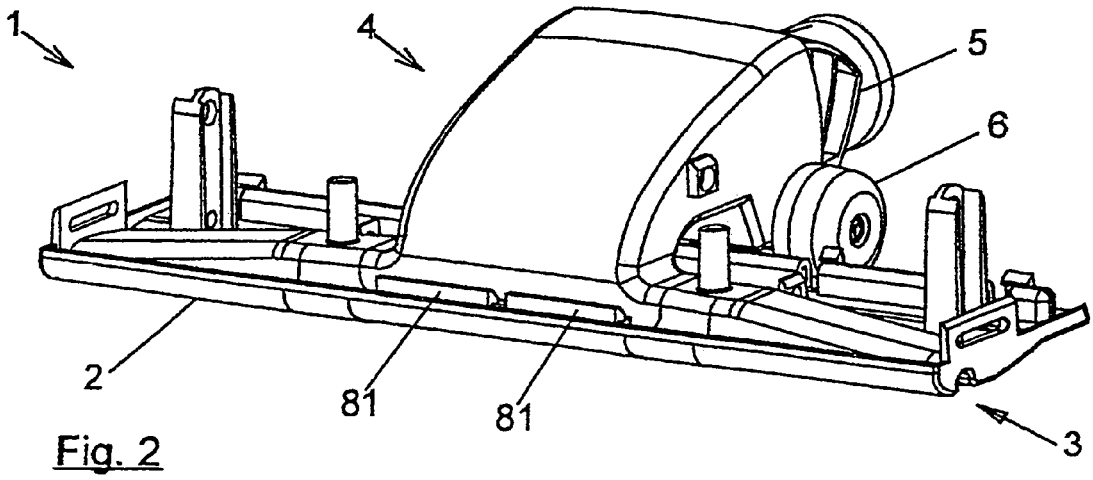
FIG. 2 is an axonometric view of a suction nozzle according to an example embodiment in which the separate/detachable suction duct has been connected to the base plate.
Figure 3:
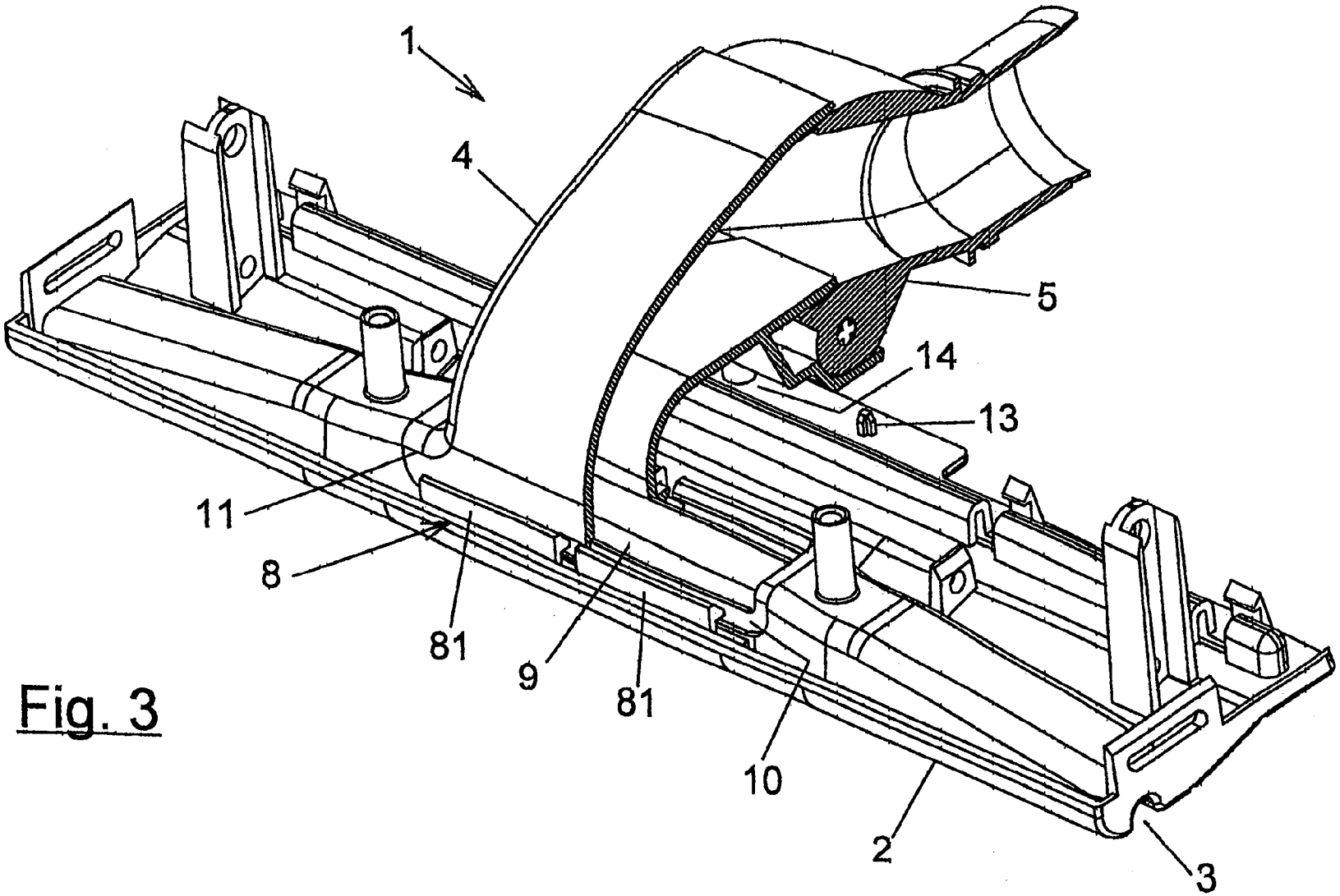
FIG. 3 is an axonometric view of a suction nozzle according to the connected in which the duct, shown partially cross-sectioned, has been constrained to the base plate.
Figure 4:
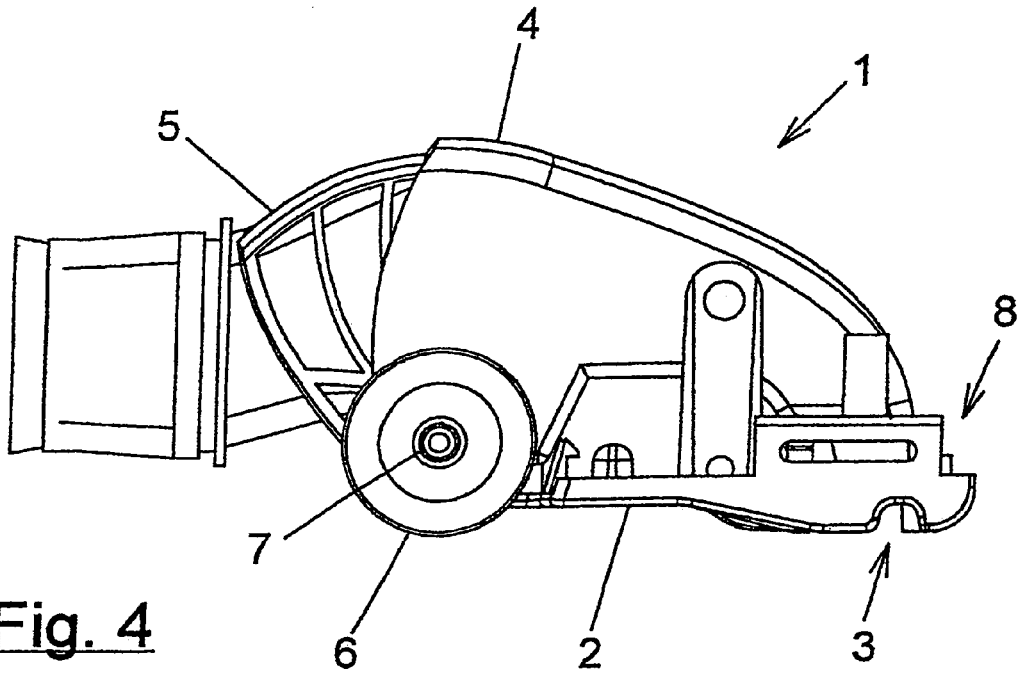
FIG. 4 shows a side view of the suction nozzle according to an example embodiment in which the separate/detachable suction duct has been connected to the base plate.
Figure 5:
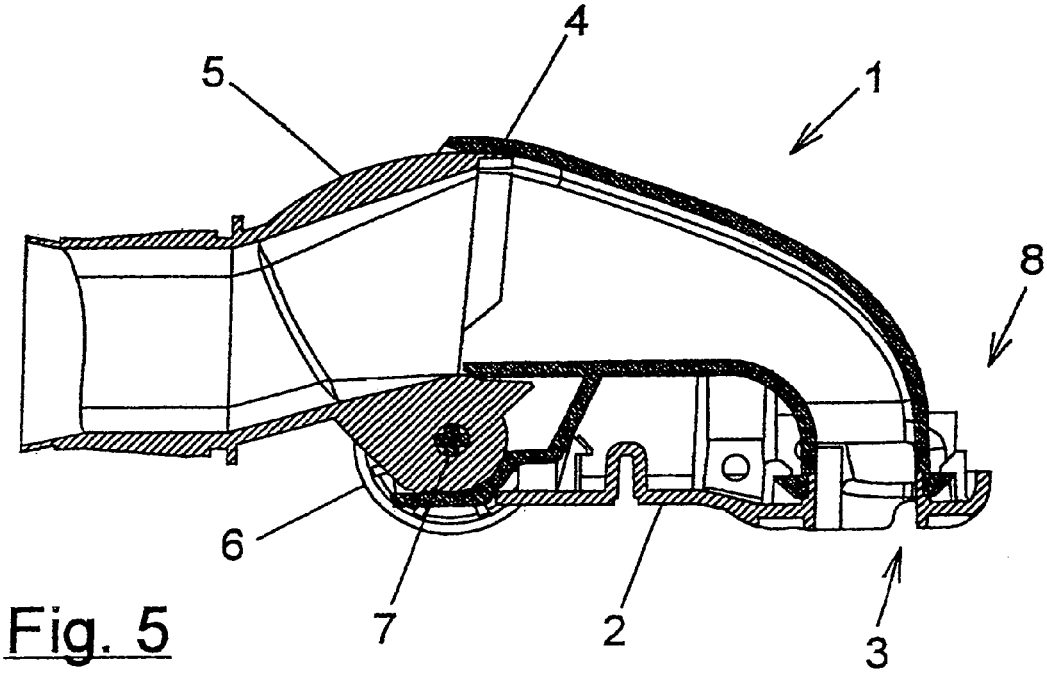
FIG. 5 is a cross-section through the suction nozzle according to an example embodiment in which the suction duct has been connected to the base plate.
Figure 6:
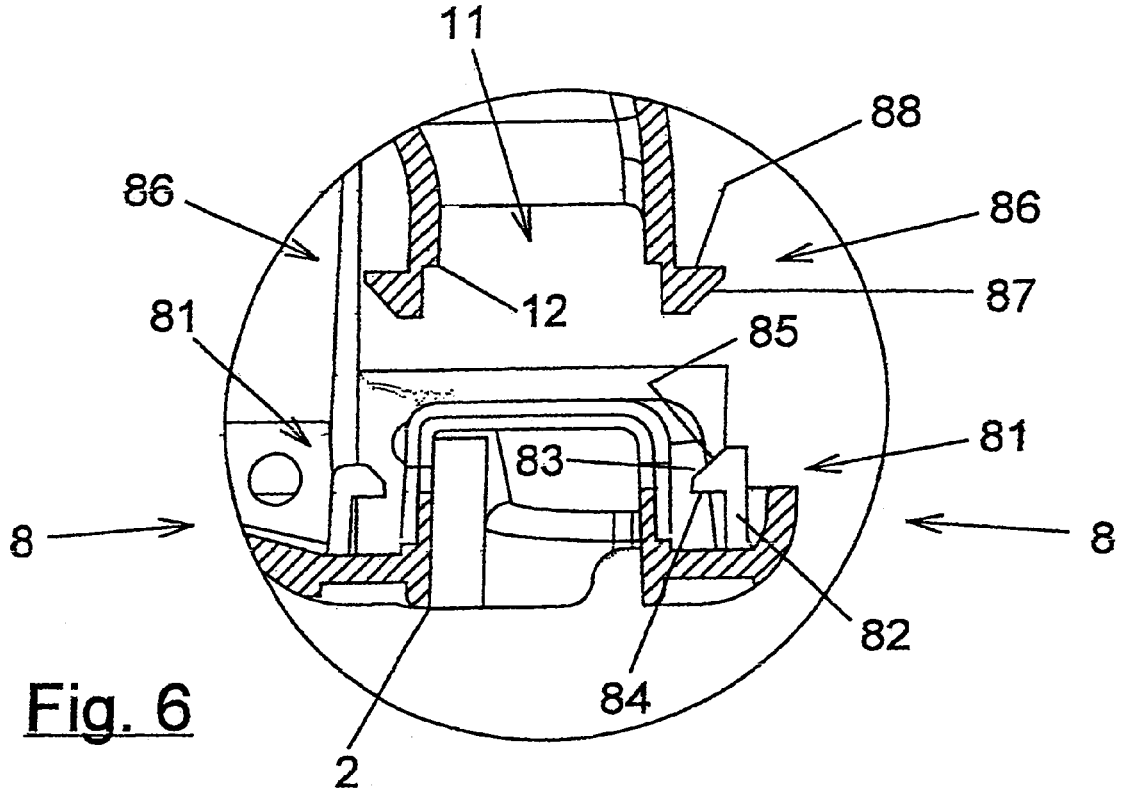
FIG. 6 is a detailed cross-section, on a larger scale, of the system for interlocking suction duct and base plate, shown separate from each other.
Figure 7:
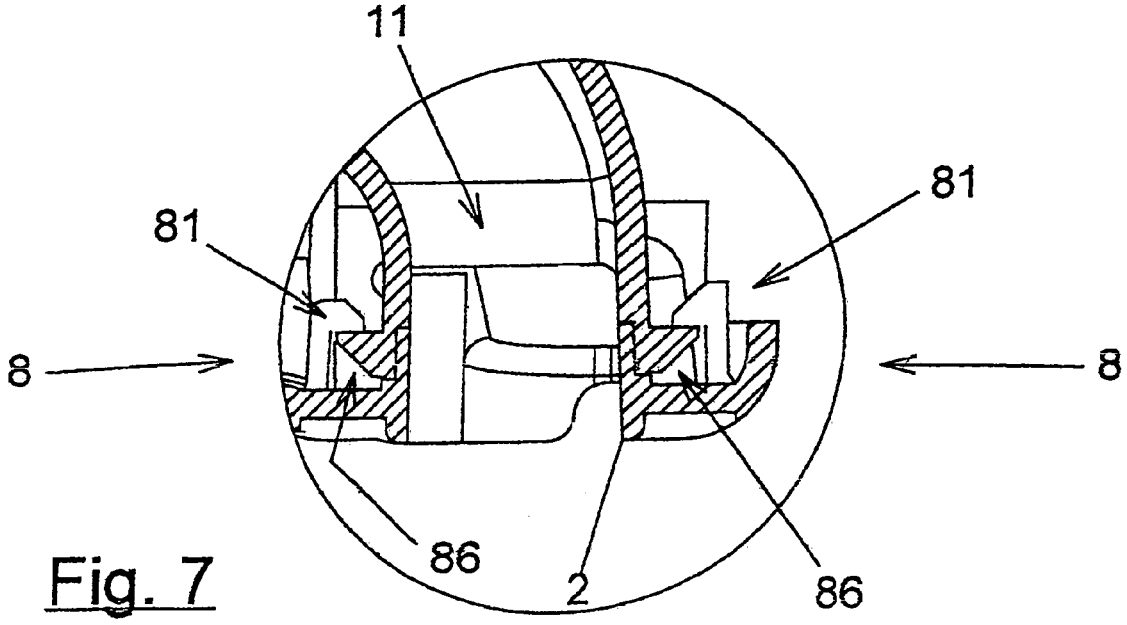
FIG. 7 is a detailed cross-section, on a larger scale, of the system for interlocking suction duct and base plate, shown connected to each other.

In the various Figures, for the sake of clarity, some components are not shown. In particular, the closing body is not shown. Likewise, the pedal and the associated actuating mechanism for moving a bristled support or a rubber fin which could be present in some embodiments are not shown.

With reference to the various Figures, a suction nozzle 1, which is typically for a vacuum cleaner, an electric brush, a multi-purpose hoover or a similar electric household appliance for cleaning by means of suction comprises a base plate 2 with at least base plate channel 3 which is open downwards, a curved and shaped suction duct 4, an articulated joint 5, a pair wheels 6 and a shaft 7 which connects them in a rotatable manner.

Suction duct 4 is not formed as one piece with the base plate 2 (or with the body, not shown), but is formed as a separate part. In the embodiment shown, the suction duct 4 is able to be connected to the base plate 2 by means of suitable connection means 8.

The connection means 8 may be mechanical means, for example a mechanical snap-engaging system and/or a screw-type or similar fixing system. Alternatively, the connection means 8 may comprise an adhesive fixing system. In particular embodiments, it may be convenient to adopt a combination of one or more of the abovementioned fixing systems: for example, a mechanical snap-engaging system and/or a screw-type fixing system and/or a fixing system which is substantially inseparable, typically realized by means of adhesive, hot-plate bonding or ultrasound.

FIGS. 1 to 8 show an embodiment where the fixing system 8 comprises a mechanical snap-engaging system.

The mechanical snap-engaging system 8 according to the embodiment shown comprises hooks 81 integral with the base plate 2 and corresponding engaging projections 86 on the inlet mouth 11 of the suction duct 4.

The base plate 2 comprises a base plate channel 3 which is open towards the surface to be cleaned (therefore substantially in the form of an overturned U) and has a central opening 9 for placing the channel 3 in fluid communication with the suction duct 4. In the embodiment shown, the base plate channel 3 is deeper at the centre, i.e. is formed with side walls which increase in height towards the centre and become smaller towards the ends of the plate. Obviously, it could also have a constant cross-section, i.e. without variations in height of the side walls.

At the central opening 9, the side walls have a limited and substantially constant height. The edge 10 of the entire central opening 9 comprises a step, i.e. the thickness of the base plate at the central opening is smaller in the vicinity of the central opening 9.

The hooks 81 formed on the base plate 2 comprise a front hook and a rear hook which are substantially symmetrical with respect to the longitudinal axis of the channel 3 in the base plate. Preferably, for mainly constructional reasons, each (front or rear) hook 81 comprises two separate hooks. Each hook comprises substantially a tongue 82 which extends upwards substantially parallel to the side surface of the base plate channel 3 and a nose 83 projecting from the tongue 82 towards the central opening 9. The nose 83 is formed by a substantially lower flat surface 84 and by an inclined surface 85. Since the base plate 2, as well as the suction duct 4, are preferably formed by means of plastic injection-moulding, the portion of the base plate 2 underneath the nose 83 is open.

The suction duct 4 comprises a shaped inlet mouth 11 which is joined to the base plate 2 in the region of the central opening 9 of the channel 3. The edge of the inlet mouth 11 also has a step 12 such that the thickness is smaller along its outer part. In other words, the base plate, in the region of the central opening, is shaped so as to be able to be connected to the suction duct 4 without creating obstacles to the air flow.

Engaging projections 86 co-operating with the hooks of the base plate are formed on a front edge and a rear edge of the inlet mouth 11. Each engaging projection 86 comprises an inclined surface 87 and an upper flat surface 88.

According to a preferred embodiment, the suction duct 4 and the base plate 2 comprise positioning/engaging members for correctly joining together suction duct 4 and base plate 2. According to a preferred embodiment, the positioning/engaging members comprise a pair of pins 13 projecting upwards from the base plate 2 and two corresponding cavities complementing the pins in the rear part of the suction duct. The cavities (not shown) are formed, in the embodiment shown in FIG. 3, inside cylinder pieces 14 extending from the rear part of the duct 4.

The connection between suction duct 4 and base plate 2 is particularly simple. Once the two components have been brought together into the correct position, it is sufficient to apply pressure so as to snap-engage the hooks 81 such that the flat bottom surfaces 84 of the hooks 81 are situated against the upper surfaces 88 of the projections 86. In this position, the positioning/engaging members 13, 14 on the duct and on the base plate are engaged so as to confirm correct relative positioning of the two members.

The suction duct 4 is formed as a piece separate from the base plate 2 and/or the body (not shown). This allows it to be made, again by means of plastic injection-moulding, with a geometrical shape suitable for specific suction and noise requirements.

Figure 8:
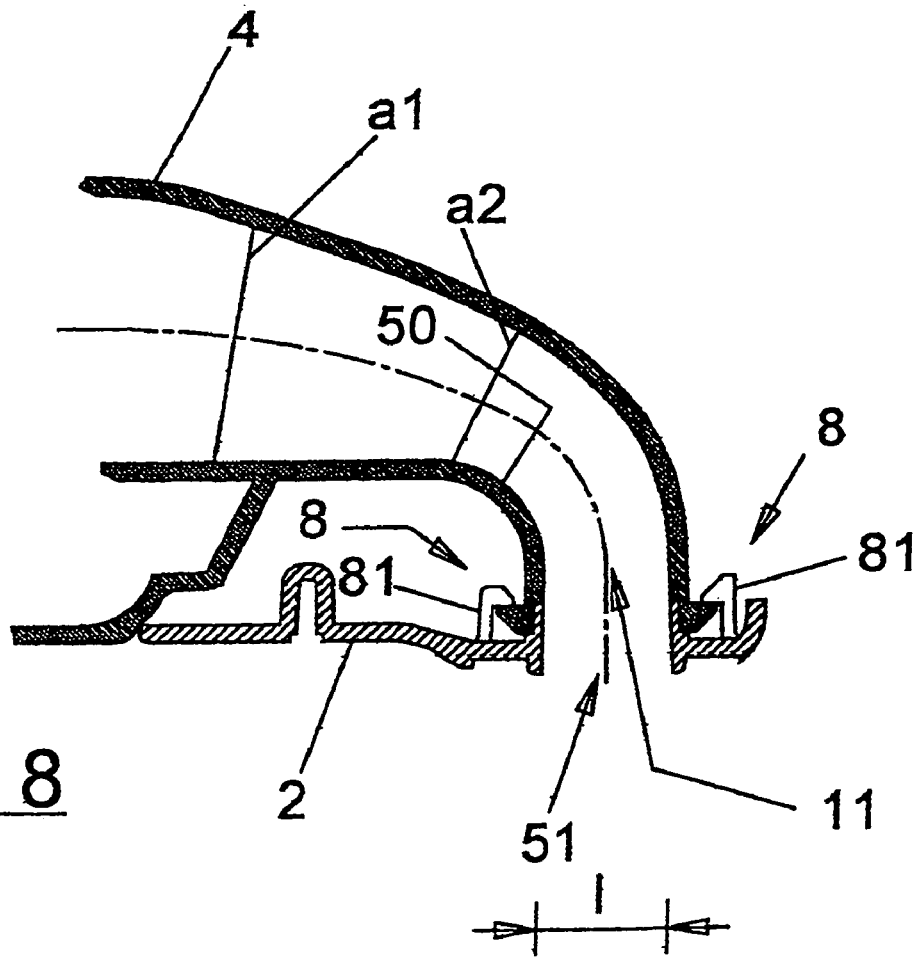
FIG. 8 is a simplified cross-section of the base plate and the duct according to an example embodiment.

Some geometrical characteristics of embodiments of suction ducts 4 will be described hereinbelow, with reference to FIG. 8, the graph of FIG. 9 and FIG. 10.

Figure 9:
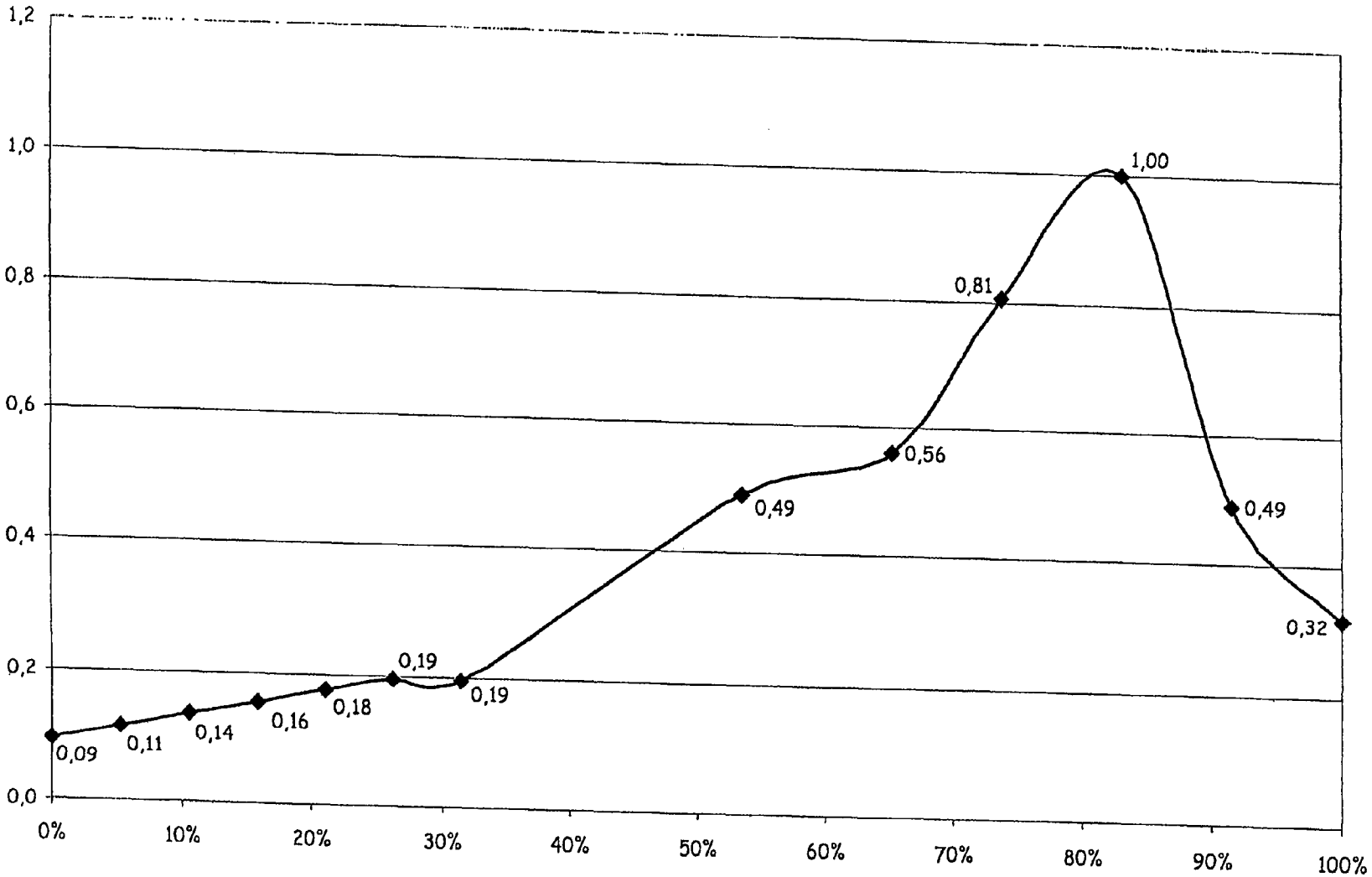
FIG. 9 is a graph illustrating the progression of a curve representing the areas of the various cross-sections of the suction channel.
Figure 10:
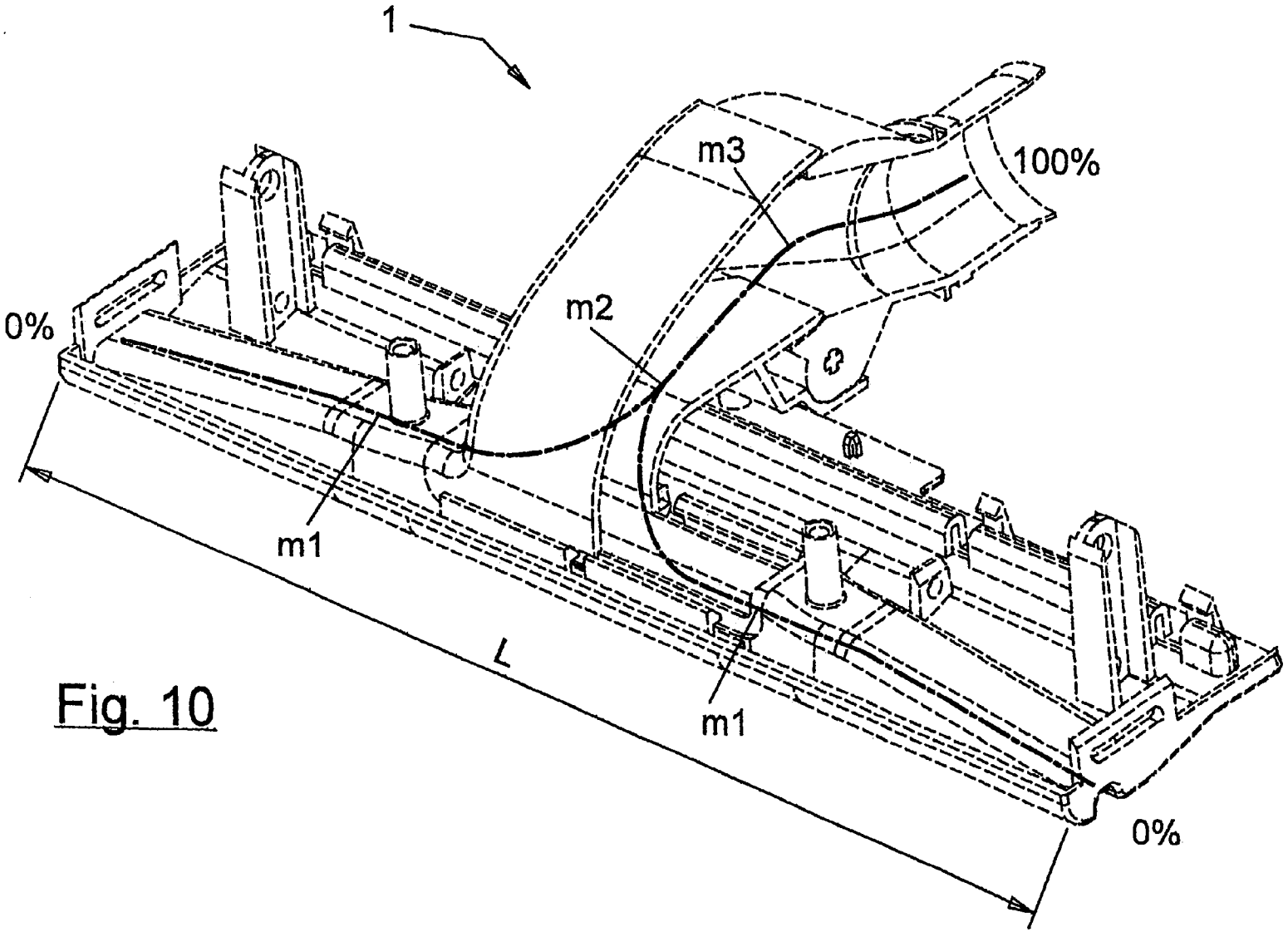
FIG. 10 is an axonometric view which shows the centre line along the air flow path and clarifies the meaning of some of the characteristics of the graph according to FIG. 9.

FIG. 9 shows a graph illustrating the progression of the curve of the areas of the various cross-sections of the suction channel 3, of the duct 4 and the joint 5. The values are not expressed as dimensions. The x axis shows the positions along the entire air flow path. According to the system chosen for the illustration (FIG. 10), a value of 0.0% represents the side inlet (right or left) of the base plate, while the value 100% corresponds to the entrance into the cylindrical part of the joint. The suction duct 4 is approximately positioned between 40-45% and 75-85%, preferably between 45% and 80%. The y axis shows the areas. The areas of the various cross-sections are calculated by considering the centre line (so-called "spine") and calculating the area passed through by the air at a cross-section perpendicular to this centre line (a centre line portion and two exemplary areas (a1 and a2) are shown in FIG. 8). The centre line and the areas in the region of the channel of the base plate are calculated assuming a channel "closed" by the floor to be cleaned.

As can be noted from the graph, the suction duct is formed by a first portion (approximately between about 40-45% and 48-53%) where the area of the cross-section increases in a substantially constant manner passing from about 0.3-0.35 to about 0.5 with a first slope m1, a second portion (between about 48-53% and 70-75%) where the area of the cross-section increases in a substantially constant manner passing from about 0.5 to about 0.6-0.65 with a second slope m2 and a third portion (between about 75% and 80%) where the area of the cross-section increases in a substantially constant manner, passing from about 0.6-0.65 to 1 with a third slope m3. The slope m1 is between about 1.0 and about 1.5, preferably between about 1.2 and about 1.4 and even more preferably is about 1.35-1.37; m2 ranges between about 0.4 and about 0.9, preferably between about 0.5 and about 0.7 and even more preferably is about 0.59-0.61; and m3 ranges between about 2.0 and about 3.5, preferably between about 2.5 and about 3.0 and even more preferably is about 2.9-3.0.

The Applicant has ascertained that the best high suction and low noise performance is obtained by designing a suction duct which is curved so as not to have sudden variations, in the manner described herein. By forming the suction duct as a single part separate from the plate and/or the body, it is possible to produce a geometrical shape with the necessary requisites in a much simpler manner than possible before.

The above may be expressed in the form of the following parameters:

- length travelled by the air (calculated starting from one end (right-hand or left-hand) of the base plate, passing through the suction duct and reaching the end of the joint): from 80% to 120% of the overall width of the brush (L). According to a preferred embodiment, the width L of the brush is about 265 mm and the length of the air flow path is about 245 mm;
- cross-sectional area: from a minimum area (in $mm^2$) equal to about 75% of the width (in mm) of the brush to a maximum area (in $mm^2$) of about 1000% of the width (in mm) of the brush. According to a preferred embodiment, the width of the brush is about 265 mm, the minimum area (in the vicinity of the right-hand/left-hand end of the base plate channel) is about 199 $mm^2$ and the maximum area is about 2650 $mm^2$.

Advantageously, the internal radius of curvature (indicated by 50 in FIG. 8) may be formed in an optimized manner compared to the known solution. The Applicant has found that this geometric characteristic is that which is most useful for obtaining the desired curve of the areas with the consequent advantages. Optimum values of the radius 50 are between 75% and 125% of the width of the cross-section at the inlet 51, as indicated in FIG. 8. According to a preferred embodiment, the width I of the inlet mouth 11 is about 14-18 mm (preferably 16 mm) and the radius 50 is about 12-16 mm (preferably 14 mm).

The invention claimed is:

1. A suction nozzle for sucking up dust and/or fluids and/or waste from a surface, said suction nozzle comprising:

i) a base plate comprising at least one channel in the form of an overturned U which is open towards said surface, ii) a suction duct in fluid communication with the at least one channel of the base plate, iii) wherein said at least one channel of the base plate has a central opening;

iv) wherein said suction duct is produced as a component separate from said base plate and from a suction nozzle body and v) wherein said suction nozzle further comprises connection means for firmly connecting said suction duct to said base plate at said central opening for placing the at least one channel in fluid communication with the suction duct.

2. The suction nozzle according to claim 1, wherein the connection means comprises a mechanical snap-engaging system.

3. The suction nozzle according to claim 1, wherein said suction duct is fixed to said base plate substantially at an end thereof which is in fluid communication with the at least one base plate channel.

4. The suction nozzle according to claim 1, wherein said suction duct and said base plate comprise positioning/engaging members for correctly joining together the suction duct and the base plate.

5. The suction nozzle according to claim 4, wherein said positioning/engaging members comprise at least one pin projecting from said base plate and said suction duct comprises at least one corresponding cavity complementing said at least one pin.

6. The suction novel according to claim 1, wherein said suction duct has a closed tubular shape comprising a suction duct shaped inlet mouth configured to be connected to said base plate at said central opening and a suction duct exit end.

7. The suction nozzle according to claim 6, wherein said suction duct, starting from said suction duct shaped inlet mouth towards said suction duct exit end, comprises a first length wherein a cross section area of the first length increases in a constant manner.

8. The suction nozzle according to claim 7, wherein said suction duct, starting from said first length towards said suction duct exit end, comprises a second length wherein a cross section area of the second length increases in a constant manner and increases more than the cross section area of the first length.

9. The suction nozzle according to claim 8, wherein said suction duct, starting from said second length towards said suction duct exit end, comprises a third length wherein a cross section area of the third length increases in a constant manner and increases more than the cross section area of the first length.

* * * * *